United States Patent [19]

Capsuto et al.

[11] 4,444,988

[45] Apr. 24, 1984

[54] USE OF LIQUEFIED PROPANE AND BUTANE OR BUTANE RECYCLE TO CONTROL HEAT OF REACTION OF CONVERTING OLEFINS TO GASOLINE AND DISTILLATE

[75] Inventors: Leon M. Capsuto, Cherry Hill; Robert E. Holland, Mullica Hill; Henry R. Ireland, Woodbury; Samuel A. Tabak, Wenonah, all of N.J.

[73] Assignee: Mobil Oil Corporation, New York, N.Y.

[21] Appl. No.: 400,828

[22] Filed: Jul. 22, 1982

[51] Int. Cl.³ ..... C07C 3/00; C07C 3/03

[52] U.S. Cl. ..... 585/415; 585/315; 585/222

[58] Field of Search ..... 585/2 SM, 310, 312, 585/415, 357, 733, 638, 639, 640, 408, 409, 469, 322

[56] References Cited

U.S. PATENT DOCUMENTS

| | | | |
|---|---|---|---|
| 1,813,880 | 2/1932 | W. K. Lewis et al. | 585/502 |
| 2,737,539 | 3/1956 | Richard C. Feitsworth | 584/502 |
| 4,012,455 | 3/1977 | Hartley Owen et al. | 585/408 |
| 3,827,968 | 8/1974 | Givens et al. | 585/322 |
| 3,998,899 | 12/1976 | Daviduk et al. | 585/252 |
| 4,197,185 | 4/1980 | Le Page et al. | |

*Primary Examiner*—Delbert E. Gantz
*Assistant Examiner*—A. Pal
*Attorney, Agent, or Firm*—Alexander J. McKillop; Michael G. Gilman; Van D. Harrison, Jr.

[57] ABSTRACT

The economics and thermal efficiency of an olefin-to-gasoline-conversion process utilizing catalyst beds is improved by separating the effluent product from the beds into a gas in a liquid phase, cooling the gas phase to form additional liquid and heat exchanging the liquid with the overhead gas from the separator.

6 Claims, 1 Drawing Figure

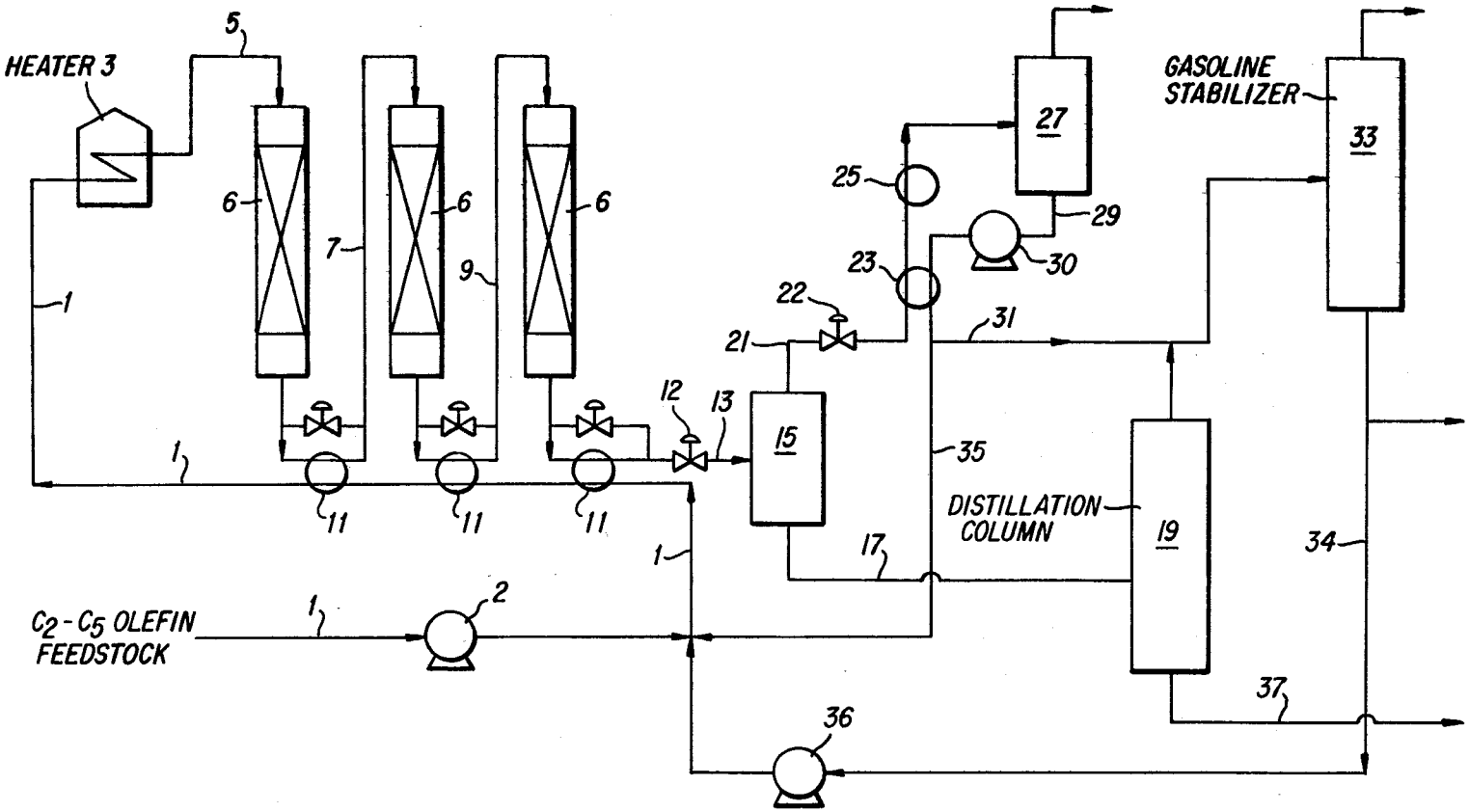
GASOLINE STABILIZER
DISTILLATION COLUMN
HEATER 3
$C_2$ - $C_5$ OLEFIN FEEDSTOCK
33
34
37
19
27
29
30
31
35
25
23
22
21
15
17
36
13
12
1
11
6
9
7
5
2

USE OF LIQUEFIED PROPANE AND BUTANE OR BUTANE RECYCLE TO CONTROL HEAT OF REACTION OF CONVERTING OLEFINS TO GASOLINE AND DISTILLATE

BACKGROUND OF THE INVENTION

1. Nature of the Invention

This invention relates to processes for catalytically converting olefins into gasoline and distillate fractions, particularly by contacting the olefins with crystalline zeolites.

2. Brief Description of the Prior Art

The conversion of olefins to gasoline and distillate products is known to those skilled in the art. For example, U.S. Pat. No. 3,960,978 discloses a process wherein gaseous olefins in the range of ethylene to pentene, either alone or in admixture with paraffins are converted into an olefinic gasoline blending stock by contacting the olefins with a catalyst bed made up of a ZSM-5 type zeolite. In a related manner, U.S. Pat. Nos. 4,021,5902 and 4,150,062 disclose processes for converting olefins to gasoline components. The process as currently developed recycles cooled gas (propane and butane) from a high-temperature, high-pressure separator downstream of the catalyst bed back into the reaction bed where additional olefins are converted to gasoline and distillate products. If the reaction of the olefins in converting them to distillate and gasoline is allowed to progress in the catalyst system without any measures taken to prevent the accumulation of heat, the reaction becomes so exothermically accelerated as to result in high temperatures and the production of undesired byproducts.

In present processes for converting olefins to gasoline components as noted previously, the warm effluent stream from the zeolite bed ordinarily is heat-exchanged with the incoming feedstock and then passed to a high-pressure gas-liquid separator where condensed liquid is separated and carried to a distillation column for further processing into a gasoline product. The overhead gas consisting primarily of butane and propane is compressed as a gas and recycled in part to the conversion process while the remainder is used for other purposes.

SUMMARY OF THE INVENTION

In accordance with this invention we have now discovered that the economics and thermal efficiency of the olefins to gasoline conversion process is considerably improved if the effluent gas from a liquid-gas separator downstream of the catalyst bed is chilled and transferred to a low pressure separator where the chilled gas is separated into a cold liquid and the liquid is then heat-exchanged with the effluent gas from the first separator and is recycled to the catalyst beds. Advantages of this arrangement included increased rates of heat transfer between flowing hot and cold fluids in the system, better control of temperatures in the reaction beds, reduced energy costs and increases in the production of gasoline and distillate product.

DESCRIPTION OF THE DRAWING

The accompanying drawing depicts a flow chart for a process of converting olefins to gasoline constituents wherein the olefin is passed through a series of zeolite beds and the effluent therefrom is chilled and at least partially condensed to the desired gasoline and distillate components.

DESCRIPTION OF THE INVENTION

The process of the invention of this disclosure is best understood by reference to the accompanying figure. $C_2$–$C_5$ olefins or feedstock containing a concentration thereof is introduced through conduit 1 and charge pump 2 and carried by a series of conduits through the heater 3 where the feedstock is heated. The olefinic feedstock is then carried sequentially through a series of zeolite beds 6 wherein at least a portion of the olefin content is converted to heavier olefinic gasoline and distillate constituents. Preferably the zeolite contained within the bed 6 is of the ZSM-5 type. Representative of the ZSM-5 type zeolites are ZSM-5, ZSM-11, ZSM-12, ZSM-23, ZSM-35 and ZSM-38. ZSM is disclosed and claimed in U.S. Pat. No. 3,702,886 and U.S. Pat. No. RE. 29,948; ZSM-11 is disclosed and claimed in U.S. Pat. No. 3,709,979. Also, see U.S. Pat. No. 3,832,449 for ZSM-12; U.S. Pat. No. 4,076,842 for ZSM-23; U.S. Pat. No. 4,016,245 for ZSM-35 and U.S. Pat. No. 4,046,839 for ZSM-38. The disclosures of these patents are incorporated herein by reference. Of these zeolites ZSM-5 is the most preferred. As will be apparent from the drawing the effluent streams from each of the beds passes in heat exchange with the incoming flow stream by means of heat exchangers 11, the heat exchangers being used to control the inlet temperatures of the second and third reactors and the temperature of high pressure separator 15. The effluent stream from the last reactor bed in exiting therefrom and through pressure let down valve 12 may have a temperature as high as 650° F. due to the heat of reaction occurring in the process taking place in the reactor beds. This effluent is carried through conduit 13 into high pressure gas-liquid separator 15. The liquid separated is transferred by means of conduit 17 into distillation column 19 where it is fractionated or otherwise treated to convert it to a gasoline or distillate product. Uncondensed vapor flows from high pressure separator 15 through conduit 21 and pressure let down valve 22 and flows through heat exchanger 23 and cooler 25 into high pressure low temperature separator 27. The cold liquid condensed in separator 27 flows out by way of conduit 29 through pump 30 to increase pressure and through heat exchanger 23 in a heat-exchange relationship with the fluid in conduit 21. A minor portion of the liquid flowing in conduit 29 is diverted to gasoline stabilizer 33 by means of conduit 31, while a minor portion of the liquid from condenser 27 is carried back into the olefin reaction chamber as recycle material by means of conduit 35. The liquid effluent leaving column 19 and gasoline stabilizer 33 can then be further processed as desired to produce a gasoline or distillate product or recycled in part through conduit 3 and recycle pump 36. The overhead vapors from separator 27 and column 33 are vented or used in other ways not relevant here.

Range of operating conditions for the gas-liquid separating system are as follows:

| | Separator 15 | Separator 27 |
|---|---|---|
| Temperature, °F. | 250–600 | 75–300 |
| Pressure, psig | 300–2000 | 100–500 |

It is the cooling step embodied in the use of cooler 25 which is deemed to be inventive in this particular application. Formerly the effluent gas leaving high pressure separator 15 through channel 21 would have been compressed and diverted partially as a gas back into the zeolite reactor system. The remaining portion would be vented to some other operation. The use of a cooler to form a liquid heat transfer medium at this location in the process results in liquifying a greater amount of the hydrocarbons produced and also results in substantial savings in heat loss.

What is claimed is:

1. A process for producing a hydrocarbon fuel boiling within the range of gasoline and distillate comprising (a) contacting a $C_2$–$C_5$ olefin, mixtures thereof or mixtures thereof with paraffins having from 1 to 5 carbon atoms with a crystalline zeolite selected from the group consisting of ZSM-5, ZSM-11, ZSM-12, ZSM-35 and ZSM-38 zeolites thereby producing a product stream comprising a liquid phase and a vapor phase;

(b) separating said product stream of (a) into a liquid phase and a vapor phase;

(c) fractionating said liquid phase of (b) into a desired gasoline fraction;

(d) passing the vapor phase of (b) through a cooling zone thereby condensing at least a portion of the propane and butene product to a liquid and forming a two-phase vapor and liquid mixture;

(e) separating the two-phase mixture of (d) into a liquid phase and a vapor phase;

(f) flowing said liquid phase of (e) in a heat exchange relationship with the vapor phase of (b);

(g) fractionating at least a portion of said liquid phase of (e) into a desired gasoline fraction; and (h) recycling a portion of said liquid phase of (e) into contact with said zeolite of (a).

2. The process of claim 1 wherein the zeolite of (a) is selected from the group consisting of ZSM-5 and ZSM-11 zeolites.

3. The process of claim 1 wherein the step of separating of (b) is conducted at temperature between about 250° F. and about 600° F. and a pressure of about 300 and about 2000 psig.

4. The process of claim 1 wherein the step of separating of (e) is conducted at a temperature between about 75° F. and 300° F. and a pressure of about 100 and about 500 psig.

5. The process of claim 1 wherein the crystalline zeolite is ZSM-5 zeolite.

6. The process of claim 1 wherein the crystalline zeolite is ZSM-11 zeolite.

* * * * *